US006703546B1

(12) United States Patent
Wilson

(10) Patent No.: US 6,703,546 B1
(45) Date of Patent: Mar. 9, 2004

(54) ERGONOMIC MULTI-POSITION GUITAR WITH LOCKING FINGERTIP TREMOLO AND PICK HOLDER

(75) Inventor: Kenneth H. Wilson, 5043 English Creek Ave., Trlr. 57, Egg Harbor Township, NJ (US) 08234

(73) Assignee: Kenneth H. Wilson, Egg Harbor Township, NJ (US)

( * ) Notice: Subject to any disclaimer, the term of this patent is extended or adjusted under 35 U.S.C. 154(b) by 0 days.

(21) Appl. No.: 10/351,622

(22) Filed: Jan. 27, 2003

Related U.S. Application Data

(62) Division of application No. 09/935,915, filed on Aug. 24, 2001, now Pat. No. 6,573,439.

(51) Int. Cl.[7] ..... G10D 3/00
(52) U.S. Cl. ..... 84/291; 84/290
(58) Field of Search ..... 84/291, 290

(56) References Cited

U.S. PATENT DOCUMENTS

| | | | | |
|---|---|---|---|---|
| 3,955,461 A | | 5/1976 | Ivie | |
| 4,339,981 A | | 7/1982 | Smith | |
| RE31,722 E | | 11/1984 | Steinberger | |
| 4,592,265 A | | 6/1986 | Steinberger | |
| 4,638,711 A | | 1/1987 | Stroh | |
| 4,763,555 A | | 8/1988 | Minakuchi | |
| 4,785,708 A | | 11/1988 | Vaughn | |
| D302,435 S | | 7/1989 | Pearse | |
| 4,882,967 A | | 11/1989 | Rose | |
| 4,903,568 A | * | 2/1990 | Itoh | 84/313 |
| D309,674 S | | 8/1990 | Gervase | |
| 5,088,375 A | | 2/1992 | Saijo | |
| 5,127,300 A | | 7/1992 | Silverman | |
| 5,311,804 A | | 5/1994 | Wilkinson | |
| D351,181 S | | 10/1994 | Whiteside | |
| 5,522,298 A | | 6/1996 | Schaller | |
| 5,649,634 A | | 7/1997 | Irizarry | |
| 5,651,468 A | | 7/1997 | Irizarry | |
| 5,796,021 A | | 8/1998 | Longshore | |
| 5,905,217 A | | 5/1999 | Byers | |
| D410,669 S | | 6/1999 | Hamre | |
| 5,986,192 A | | 11/1999 | Wingfield | |
| 6,573,439 B2 | * | 6/2003 | Wilson | 84/291 |

OTHER PUBLICATIONS

Our World; Model 2; Oct. 30, 2000; http://ourworld.compuserve.com.
Klein Electric Information; Oct. 30, 2000; www.kleinelectricguitars.com.

* cited by examiner

*Primary Examiner*—Kimberly Lockett
(74) *Attorney, Agent, or Firm*—Anthony L. Birch

(57) ABSTRACT

An electric guitar or other similar stringed instrument is provided. The guitar is ergonomically designed to provide a maximum amount of comfort and stability in a variety of playing positions, both sitting and standing, while producing a minimum amount of fatigue in the instrumentalist. Primary features include: a locking and pivoting legrest, which can rest either on the instrumentalist's left leg or upon the chair on which he is seated; an instantly adjustable locking mechanism for the aforementioned legrest; a selection of multi-adjustable and removable armrests which support the plucking or strumming arm of the instrumentalist; a body design which is shaped as close as possible to the guitar's bridge allowing the guitar to be brought more front and center (than traditional guitar design permits) when used in the sitting position; body shaping which includes smooth contours, a long inward curved upper horn for balance and stability, full access to the guitar fingerboard, and a minimum of body size and weight; an adjustable side rest which transfers weight placed upon the armrest to the instrumentalist's side and increases stability during use; and a belly rest which increases stability between the back of the guitar and instrumentalist's abdominal region. Performance related inventions of this guitar include; a specialized fixed tremolo bar which remains accessible to the instrumentalist's fingertips at all times; a specialized tremolo lock for use with the aforementioned tremolo bar; and a guitar pick holder designed for convenient and unobtrusive placement.

2 Claims, 5 Drawing Sheets

ERGONOMIC MULTI-POSITION GUITAR WITH LOCKING FINGERTIP TREMOLO AND PICK HOLDER

The application is a Division of Application No. 09/935,915 filed on Aug. 24, 200, now U.S. Pat. No. 6,573,439, the entire contents of which are hereby incorporated by reference.

BACKGROUND OF THE INVENTION

1. Field of the Invention

The present invention relates to an electric guitar or other stringed instrument ergonomically designed to maximize comfort and stability of playing positions, both sitting and standing, while producing a minimum amount of fatigue in the instrumentalist.

2. Related Background Art

Heretofore devices exist for use with the guitar in order to make it more easily playable and expressive. One of the most common problems associated with playing the guitar is physical discomfort —particularly back and shoulder pain —derived from holding the instrument. Patents: RE 31,722; 4,592,265; 3,955,461; DES 410,699; and 4,339,981 are just a few of the attempts at producing a more comfortable or stable guitar.

Most guitar designs require the instrumentalist's back to twist when seated with the guitar. The back twists to the right when the guitar is placed upon the right thigh and to the left when the guitar is placed upon the left thigh. Also, when placed upon the left thigh, additional stands or footrests are often used under the left foot, throwing the hips out of alignment. Shoulder strain is often induced from holding the instrument in these positions as well.

SUMMARY OF THE INVENTION

Accordingly, it is a primary object of the present invention to provide a stringed instrument, which maximizes comfort of the instrumentalist in multiple playing positions.

The objects of the present invention are fulfilled by providing an ergonomically designed stringed instrument comprising: a main body portion having first and second spaced distal end faces longitudinally thereof, and spaced distal top and bottom faces vertically thereof, and spaced front and rear surfaces; an elongated fingerboard extending from a first one of said end faces; a bridge for supporting strings of the instrument disposed closely adjacent to the second one of the end faces; a leg rest attached to a second end face and extending therefrom, said leg rest being angularly adjustable between selectable supporting positions; an upper horn extending from a region of the top face of the body, said upper horn having a contoured rear surface shaped to conformingly engage the upper body of the instrumentalist; and a belly rest extending from the rear surface of the instrument for engagement with an instrumentalist's abdomen.

It is the intention of this invention to eliminate the aforementioned problems by allowing the instrumentalist to sit almost perfectly at ease; with a straight back, even hips, and relaxed shoulders. One significant point in achieving this is shaping the guitar body below the bridge as close to the bridge as possible. This shape allows the guitar bridge to rest just above the instrumentalist's right thigh, as opposed to off the right side of the instrumentalist's right thigh (the norm in traditional guitar body design). This straightens the instrumentalist's back as the guitar moves to center, as well as reduces strain in the right shoulder.

With the guitar body contacting the instrumentalist's right thigh at a point below the bridge near the end of the guitar, a significant amount of the weight of the guitar is shifted to the instrumentalist's left. This weight is held, and the guitar kept in balance, by the multi-adjustable leg rest. The legrest curves toward the back of the guitar so that it more appropriately rests upon the instrumentalist's left thigh as opposed to toward his knee. This provides a better sense of balance and stability. The legrest curvature also provides a better angle for the legrest to rest on the chair which the instrumentalist is seated upon when this option is chosen.

Use of the legrest allows the position of the guitar's neck (and body) to be set to the instrumentalist's preference and comfort. However, it is the observation of the inventor that even a "perfect" playing position can cause fatigue and physical discomfort if it is maintained unchanged for a long period of time. Thus the adjustable features of this guitar body design (legrest, armrest, and side rest) allow the instrumentalist to position himself within a range of ideal positions with instant adjustments. Even odd positions, such as sitting back on a soft sofa or on the floor, can be accommodated. The use of a guitar strap with this instrument will also provide variations in stability and comfort. No other guitar provides such a wide range of adjustable comfort and support options.

The adjustable armrest is designed to reduce tension and fatigue in the instrumentalist's right shoulder. Typical guitar design requires that the instrumentalist often hold his arm in an up, outward, or back position which can produce fatigue (especially over long periods of time). The adjustable armrest allows the weight of the arm to be held in a natural, relaxed position with a minimum of effort and therefore fatigue. The curvature of the armrest can provide horizontal support, which prevents the weight of the instrumentalist's arm from falling towards the ground, as well as vertical support, which prevents the instrumentalist's arm from falling in towards his body. The armrest can pivot as well as slide along a support arm. A variety of armrests, with different heights and curvatures, can also be quickly selected or changed with the use of the quick release armrest clamp. The instrumentalist may also play the guitar with the armrest removed for further variety and comfort.

It is the inventor's observation that when weight of the right arm rests upon the body of a guitar (traditional design or the current invention) that the guitar tends to spin and fall toward the back of the instrumentalist. This requires extra effort to hold the guitar in place and produces fatigue. To remedy this common problem, the current invention includes an adjustable side rest placed at the back of the guitar just behind the armrest. The side rest transfers weight placed upon the armrest to the instrumentalist's side and eliminates the guitar's tendency to spin. Fatigue is greatly reduced and stability increased as the armrest can more fully support weight applied to it. The side rest is quickly adjustable by sliding it along a support base. Different side rest adjustments provide varying degrees of support.

Other ergonomic guitar body features include: a belly rest to provide stability where the instrument contacts the instrumentalist's abdominal area; a long inward curving upper horn for support against the instrumentalist's chest, as well as balance; strap buttons located at the end of the long upper horn as well as at the end of the armrest support base arm —this provides for better balance of the instrument and does not pull the instrument uncomfortably into the instrumentalist's body as in traditional guitar design where the strap buttons are located in the same plane as the guitar's main body (the human body is round, not flat); guitar body shaped and tapered to meet the instrumentalist's right arm at approximately 90 degrees; the lower edge of the guitar and legrest shaped at approximately 15 degree angle to accommodate the slight backward tilt of the guitar body in playing position; guitar body shaped to allow full fingerboard access; smooth body shaping (cutaway) where the back of the guitar meets the instrumentalist's ribcage area; and overall smooth body shaping and rounding with a minimum of body size and weight.

Performance related improvements to this guitar include the fixed tremolo bar and fixed tremolo bar locking mechanism. A significant amount of prior art exists describing tremolos as well as several tremolo locks. The basic function of tremolos is to add musical expressiveness by allowing the lowering and/or raising of the pitch of the guitar strings. The disadvantage with most tremolo arms is that they often have to be grabbed for when their effect is desired and then pushed away or allowed to fall when no longer needed. A fixed tremolo bar, which remains instantly ready at the instrumentalist's fingertips, is highly desirable. This eliminates the need to go grabbing for the tremolo arm at awkward or inopportune moments and provides constant tremolo access. A tremolo bar cavity allows for use of the tremolo by providing space for the instrumentalist's fingertips to work the tremolo as well as space for the tremolo bar to move in towards the guitar's body when lowering the pitch of the strings.

The usefulness of a tremolo lock is well documented in prior art. At times, the tremolo effect is undesirable as it can adversely affect the pitch and tuning stability of the guitar. A sliding latch type tremolo lock is included for use with the fixed tremolo bar. This sliding latch tremolo lock provides the ability to instantly lock or unlock the tremolo as desired. No other tremolo lock consists of a sliding latch which engages the tremolo bar. This is due largely to the relative uniqueness of the fixed tremolo bar (most pivot their connection with the base). This lock will only properly engage the specialized fixed tremolo bar. Traditional (unfixed or floating) tremolo arm motion would allow the tremolo arm to be pushed out of the way by the lock latch if attempted.

The usefulness and desirability of guitar pick holders are well documented in prior art. However, most of these are external devices that are clamped or stuck upon the surface of the guitar. These others may function well at holding picks but suffer one or more of the following problems: the pick holder is visually detracting; the pick holder, if placed for optimum convenience of use (in the strumming area near the strings) is physically obstructive to playing, i.e., it can be hit while strumming the strings; the pick holder does not hold the pick in a "ready to play" position". Therefore, an improved pick holder would hold the pick in a ready position, be mounted unobtrusively and be placed within the strumming area.

A flush mounted guitar pick holder has been included in this invention, built into the guitar body itself. No other pick holder known to the inventor makes this claim. By building the pick holder into the instrument, exact placement and usefulness can be achieved with virtually zero obtrusiveness to the instrumentalist. This design is especially useful for switching between pick and non-pick (fingerstyle) playing.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
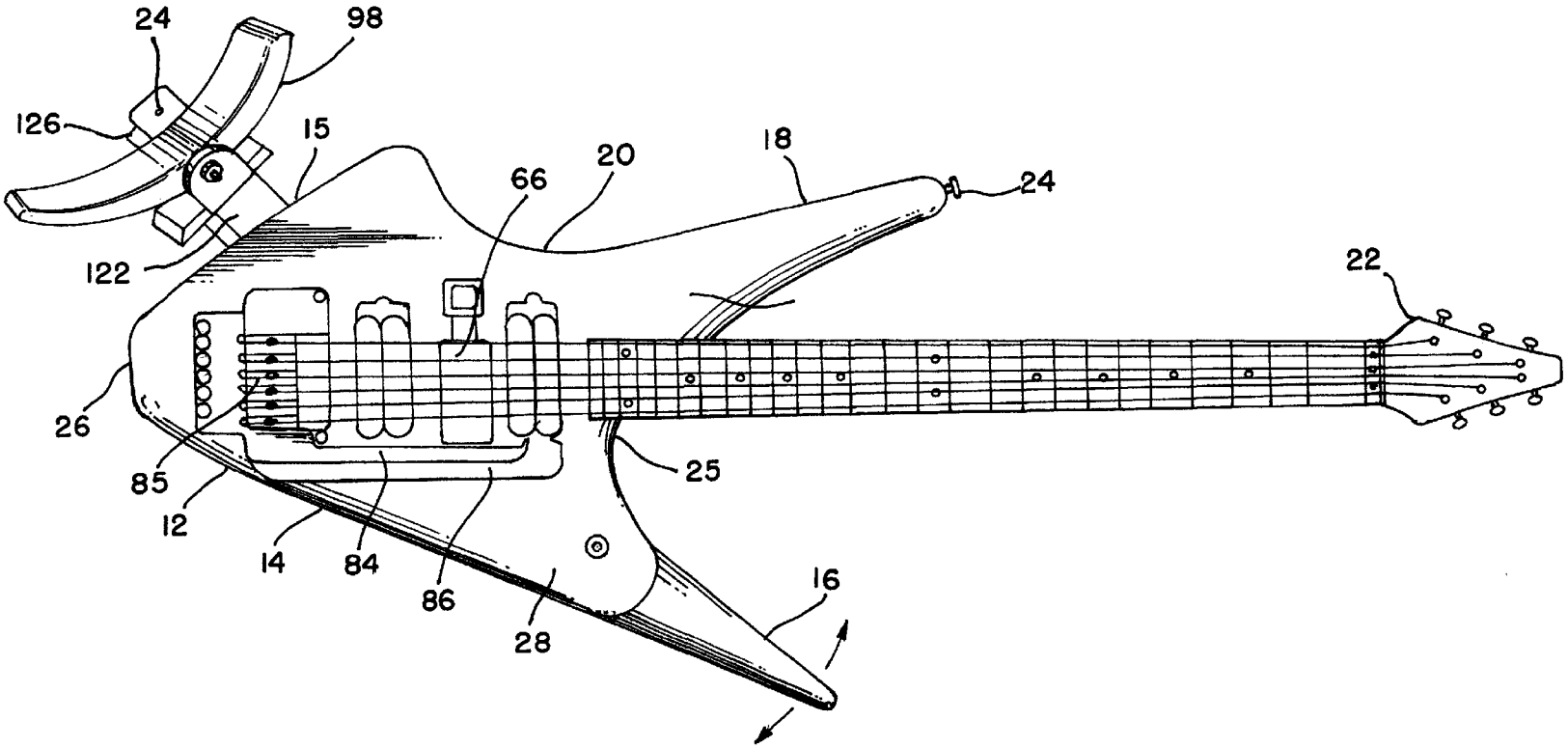
FIG. 1 is a front elevational view of the overall shape and combination of the elements of the ergonomically designed guitar of the present invention.

FIG. 1 is a front elevational view of the overall shape and combination of elements of the ergonomically designed guitar of the present invention. The Main Body 10 is shaped so that the bottom face of the guitar is as close as possible in region 12 to the Guitar Bridge 85. This allows for more comfortable use of the instrument—particularly in the seated position. The bottom face is also angled at approximately fifteen degrees 14 (not readily visible in FIG. 1) from the front to the rear surface to accommodate the backward leaning of the instrument upon the instrumentalists lap. The top face of the body 10 is rounded and shaped at region 15 to meet the instrumentalists strumming or plucking arm at approximately ninety degrees. Continuing along the top face is a smooth contour for contact with the instrumentalist's body 20 and a long inward curving Upper Horn 18 for stability, balance and comfort. The distal end to which the instrument's neck is attached is smoothly cut away at 25 to allow for full access to the highest frets of the neck.

A pivoting Legrest 16 (detailed in FIG.2) provides the instrumentalist with a variety of options for comfort and stability. The Legrest 16 is also removable if that option is not chosen by the instrumentalist.

Figure 6:
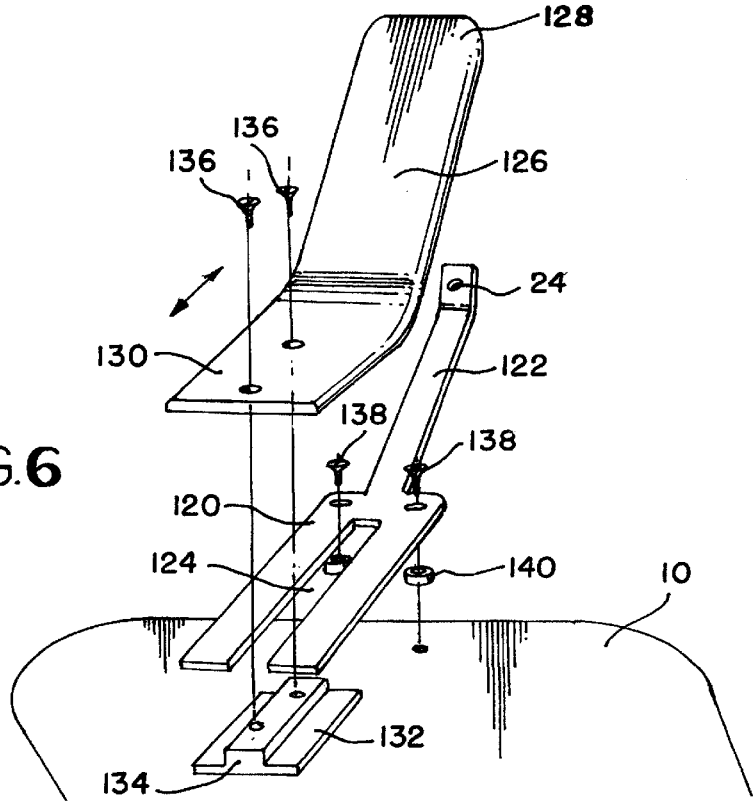
FIG. 6 is an exploded, perspective view of a siderest for use with the armrest of FIGS. 5A and 5B.
Figure 5A:
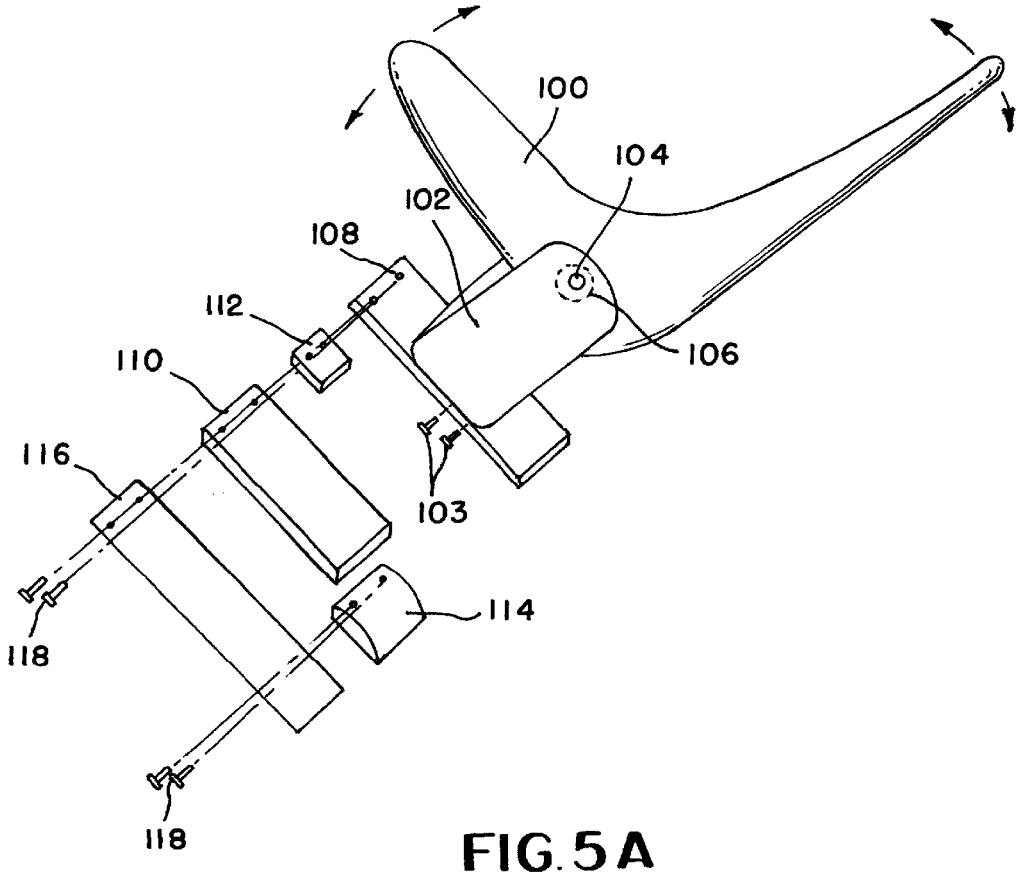
FIG. 5A is an expanded perspective view depicting the armrest of the present invention.
Figure 5C:
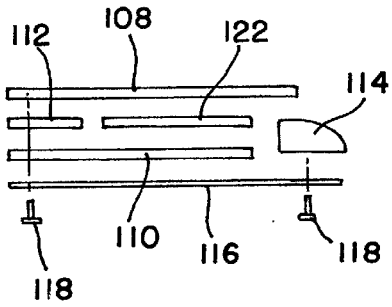
FIG. 5C is a cross-sectional view taken along line 5C—5C of FIG. 5B.
Figure 5B:
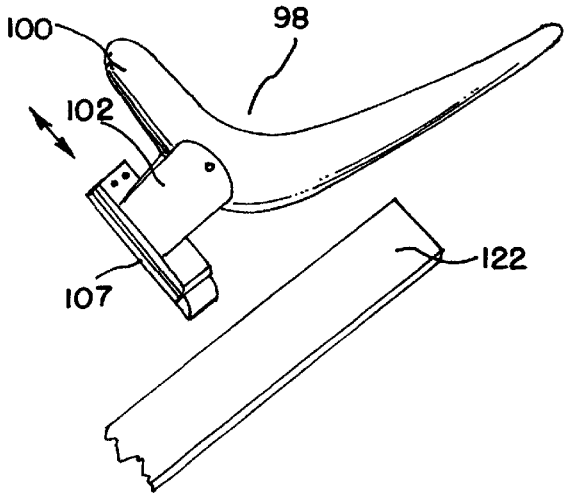
FIG. 5B is an assembled perspective view of the armrest of FIG. 5A shown separated from a support base arm thereof.

The Armrest Clamp Assembly 98, detailed in FIGS. 5A–5C, is mounted upon the Support Base Arm 122—part of the Support Base 120 detailed in FIG. 6—which is mounted in turn to the rear face of the guitar. The Armrest Clamp Assembly 98 provides for a variety of supporting positions for the instrumentalists strumming or plucking arm. The Armrest Clamp Assembly 98 is also removable as well as interchangeable with other Armrest Clamp Assemblies of different heights and curvatures.

The adjustable Side Rest 126 (detailed in FIG. 6) transfers weight placed upon the Armrest 100 to the instrumentalist's side as well as provides stability. Strap Buttons 24 are located at the tip of the Upper Horn 18 and at the tip of the Support Base Arm 122 for comfort, stability, and balance of the instrument. An alternate strap button location 26 is suggested for use if the Armrest Assembly 98, Siderest 126, and Support Base 120 (and thus Support Base Arm 122) options are not chosen by the instrumentalist.

The Fixed Tremolo Bar 84 Provides for instant control of the tension (and therefore pitch) of the strings of the present invention. Both the raising and the lowering of the pitch of the strings are directly controllable from the Fixed Tremolo Bar 84 by the instrumentalist's fingertips. The Tremolo Bar Cavity 86 provides space for Tremolo Bar 84 usage as well as the instrumentalist's fingertips. The Tremolo Lock Assembly 66 (detailed in FIGS. 3–4) instantly locks the tremolo system when desired.

An internally mounted Guitar Pick Holder 28 (detailed in FIGS. 7A–7C) is included on the front face of the main body 10 for the convenience of the instrumentalist.

A symmetrical headstock shape 22 is suggested for the present invention to provide for best stability when placed in hanging type guitar stands and racks for display.

Figure 2:
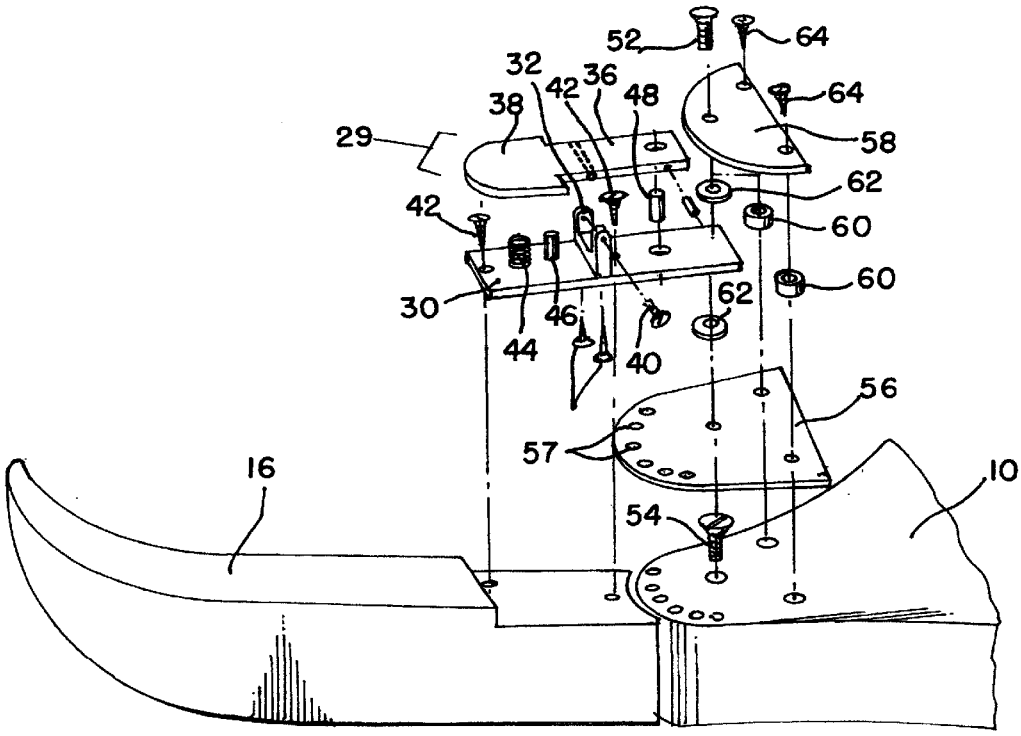
FIG. 2 is an exploded, perspective view of a of a legrest portion of the guitar of FIG. 1.

In FIG. 2, the multi-positional Legrest 16 pivots and locks through the use of the Legrest Pivot/Locking mechanism assembly 29. The Legrest 16 itself is a separate piece from the Main Body 10. The Legrest Lock Base Plate 30 mounts to the rear of the Legrest 16 with the Legrest Lock Base Plate Mounting Screws 42. Upon the Legrest Lock Base Plate 30, the Legrest Lock Lever Bracket 32 is mounted with the Legrest Lock Lever Bracket Mounting Screws 34. This Bracket 32 serves as a fulcrum/pivot point for the Legrest Lock Lever 36, which is bolted into it with the Legrest Lock Lever Pivot Bolt 40. Beneath the Thumb Tab 38 portion of the Lock Lever 36 is a Depth Stop 46, which keeps the Lever 36 from being depressed too far, and a Lock Lever Spring 44 to return the Lever 36 to a locked position when it is released. A Locking Pin 48 is bolted into a hole in one end of the Legrest Lock Lever 36 with the Legrest Locking Pin Pivot Bolt 50. When the Thumb Tab 38 of the Locking Lever 36 is depressed, it causes the Locking Pin 48 at the other end of the Lever 36 to rise through a Locking Pin Receiving Hole 57 in the Legrest Lock Bottom Body Plate 56 and thus unlocks the Legrest Locking Mechanism 29. The Thumb Tab Depth Stop 46 keeps the Locking Pin 48 from being lifted out of the hole in the Legrest Lock Base Plate 30. With the Thumb Tab 38 depressed, the Locking Assembly 29, and thus the Legrest 16, can pivot on a Pivot Bolt 52 which mounts through the other end of the Legrest Lock Base Plate 30—in between the Top and Bottom Legrest Lock Body Plates 58 and 56, the Legrest Lock Pivot Bolt Washers 62, and into a Threaded Insert 54 in the guitar main body 10. The Legrest Lock Bottom Body Plate 56 has Locking Pin Receiving Holes 57 along an arc of the circumference of a circle about 1 inch from the Legrest Lock Pivot Bolt 52. The different Locking Pin Receiving Holes 57 allow the Legrest 16 to be locked in different positions. These Receiving Holes 57 receive the Locking Pin 48 when the Legrest Locking Mechanism 29 is adjusted and the Legrest Locking Lever Thumb Tab 38 is released, and thus (with the Legrest Lock 44 pushing upon the Lock Lever 36 and driving the Locking Pin 48 into one of the Locking Pin Receiving Holes 57), locks the Legrest 16 in that position. The Legrest Lock Top and Bottom Body Plates 58 and 56 mount to the Main Body 1C with the Legrest Lock Body Plate Mounting Screws. Legrest Lock Body Plate Spacers 60 are used to provide space for the Legrest Lock Base Plate 30 to pivot between the Body Plates 58 and 56.

The Tremolo Bar 84 (FIGS. 1 and 4) is of a specialized fixed type which remains ready for use at the instrumentalist's fingertips at all times. It does not pivot in regards to the Tremolo Bridge 85 (FIGS. 1 and 4) as is the norm in traditional design. The Tremolo Bar 84 Bolts directly to the Tremolo Bridges' 85 base plate or block. The lower edge of the Tremolo Bar 84 is Tapered and Rounded 88 (FIG. 4) to allow better gripping and control by the instrumentalist's fingertips. A Tremolo Bar Cavity 86 (FIG. 1) is routed into the guitar body to allow for tremolo bar usage as well as for the instrumentalist's fingertips during usage.

Figure 3:
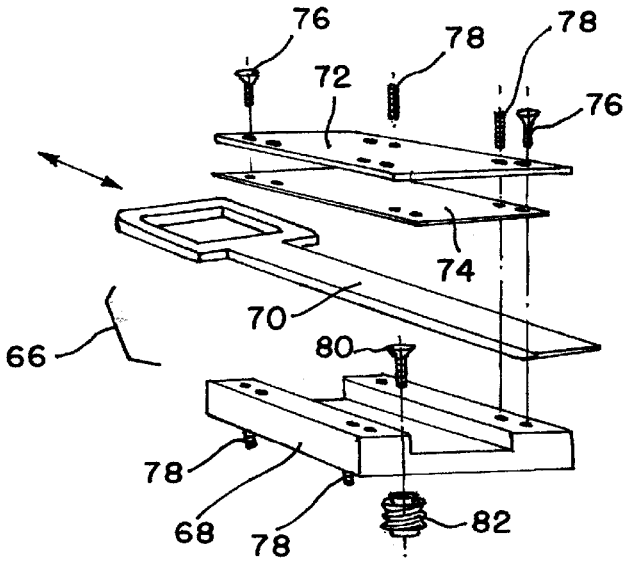
FIG. 3 is an exploded, perspective view of a tremolo bar and locking mechanism for use with the guitar of FIG. 1.
Figure 4:
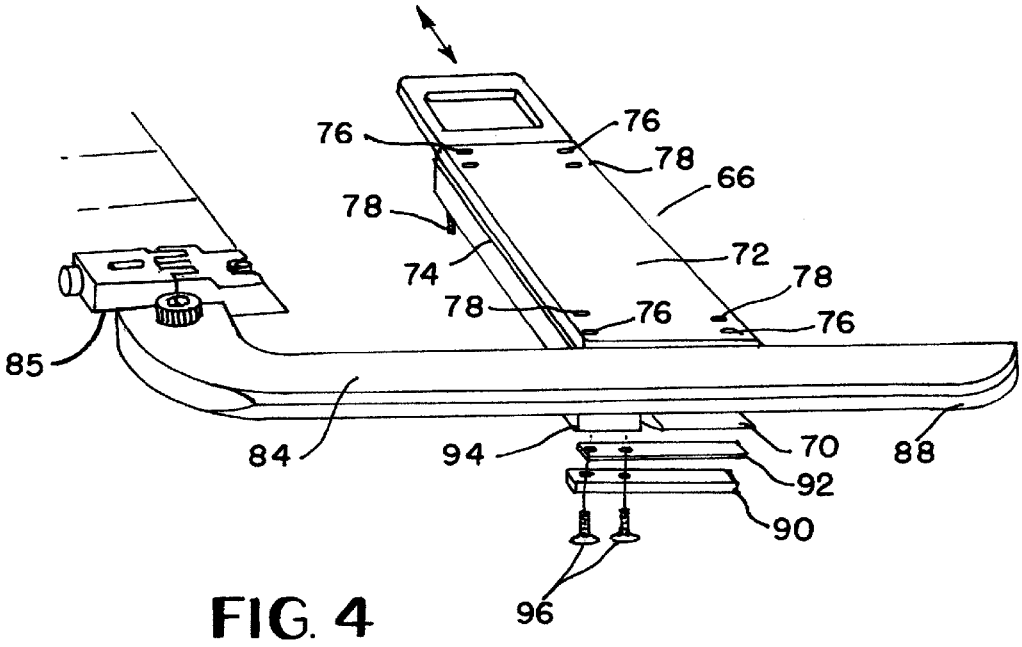
FIG. 4 is an assembled perspective view of a tremolo bar and locking mechanism of FIG. 3.

The Tremolo Lock Assembly 66 (FIGS. 1, 3, and 4) mounts to a Threaded Insert 82 (FIG.3) in the guitar Main Body 10 in a simple routed cavity (not pictured) with a single Tremolo Base Mounting Bolt 80, which passes through the center of the Tremolo Lock Base 68 (FIG. 3). In FIG. 4, the Tremolo Lock Latch 70 slides through a channel in the Tremolo Lock Base 68 to engage the bottom of the Tremolo Bar 84. As shown in FIGS. 3–4, four Tremolo Lock Alignment Screws 78 in the Tremolo Lock Base 68 adjust to level the plane of the Lock Base 68, and thus the Lock Latch 70, for perfect contact with the bottom of the Tremolo Bar 84. A Tremolo Lock Pressure Plate 72 and a thin rubber Tremolo Lock Pressure Washer 74 adjust the desired feel or tightness of the Tremolo Latch 70 sliding within the Tremolo Lock Base 68. One end of the Tremolo Latch 70 has a hole 70A in it, which provides access for one-finger adjustments by the instrumentalist. The opposite end of the Tremolo Latch 70 slides to engage the bottom of the Tremolo Bar 84 (FIG. 4) and prevents downward motion of the Tremolo Bar 34 (thus preventing lowering the pitch of the strings). To prevent the Tremolo from moving upward (causing the pitch of the strings to rise), a Tremolo Lock Up-Pull Stop 90 (FIG. 4) is mounted to the bottom of the Tremolo Bar 84 with the Up-Pull Stop Mounting Screws 96. This Up Pull Stop 90 catches against the tip of the Lock Latch 70 when the Latch 70 is in the locked position. A Tremolo Lock Up-Pull Stop Spacer 94 is mounted between the Up-Pull Stop 90 and the Tremolo Bar 84 to provide for the thickness of the Lock Latch 70. A small Tremolo Lock Spring Clip C52 (a slightly bent piece of thin spring steel) is mounted between the Up-Pull Stop 90, and the Up-Pull Stop Spacer 94 to prevent any slack space around the Lock Latch 70 when it is in the locked position. This prevents any unwanted noise caused by sympathetic vibrations. The bottom edge of the Lock Latch 70 (facing away from the Tremolo Bar 84) is slightly tapered or curved to facilitate its sliding between the Tremolo Bar 84 and the Up-Pull Stop 90 (and Spring 92).

In FIG. 5B, the Multi-positional Armrest Clamp Assembly 98 mounts upon the Support Base Arm 122, which is attached to the rear of the main body of the guitar. The Armrest Assembly 98 can be attached to and removed from the Support Base Arm 122 with the Armrest Clamp 107. Once attached, the Armrest Clamp 107 slides longitudinally upon the Support Base Arm 122. As shown in FIGS. 5A and 50, an Armrest Clamp Spacer 112 between the Armrest Clamp Top Plate 108 and the Armrest Clamp Bottom Plate 110 provides for the thickness of the Support Base Arm 122. The Armrest Clamp Spacer 112 also functions as a stop when the Armrest Clamp 107 slides upon the Support Base Arm 122. As the Armrest Clamp 107 slides upon the Support Base Arm 122, the Armrest Clamp Locking Tab 114 is pushed backwards away from the Support Base Arm 122. The Armrest Clamp Locking Tab Spring 116 (a flexible piece of flat spring steel in the prototype) allows for the Locking Tab's 114 motion (storing tension). As the Armrest Clamp 107 completes sliding upon the Support Base Arm 122, the Locking Tab 114 passes the edge of the Support Base Arm 122 and snaps snugly against the lower edge of the Support Base Arm 122, releasing the tension stored in the Locking Tab Spring 116. To remove the Armrest Clamp 107, the Locking Tab 114 is lightly depressed. This allows the Locking Tab 114 to clear the Support Base Arm 122 so the Armrest Clamp 107, and thus the entire Armrest Clamp Assembly 98, can be removed.

The Armrest 100 itself mounts in the Armrest Bracket 102. A single Armrest Pivot Bolt 104 with Armrest Pivot Bolt Washers 106 between the Armrest Bracket 102 and the Armrest 100 allows the Armrest 100 to pivot in the Armrest Bracket 102 as well as provides necessary adjustable tension for the Armrest 100 to support the weight of the instrumentalist's arm. The Armrest Bracket 102 is mounted to the Armrest Clamp Top Plate 108 with the Armrest Bracket Mounting Screws 103. Different Armrest curvatures, including flat, should be available to provide for different instrumentalist taste and needs. Different Bracket heights should also be available.

As shown in FIG. 6, the adjustable Side Rest 126 slides upon the Support Base 120, which is mounted to the rear face of the Main Body 10 of the guitar. Along the center of the Support Base 120 is the Support Base Slot 124. The Side Rest 126 is bolted to the Side Rest Pressure Plate 132 with the Side Rest Pressure Plate Mounting Screws 136 through the Support Base Slot 124. It is important that the Side Rest Pressure Plate 132 has room to move between the Support Base 120 and the Main Body 10 of the guitar. To provide for this space, Support Base Mounting Spacers 140 can be mounted between the Support Base 120 and the Main Body 10 or a shallow channel (not pictured), parallel to the Support Base Slot 124, can be routed into the Main Body 10 of the guitar. The Side Rest Pressure Plate Ridge 134 in the center of the Side rest Pressure Plate 132 keeps the Side Rest Pressure Plate 132, and thus the Side Rest 126, in alignment with the Support Base 120 as it slides along the Support Base Slot 124. By pressing down on the Side Rest Base 130, the Side Rest 126 can be adjusted along the Support Base 120. Adjustment of the Side Rest Pressure Plate Mounting Screws 136, which connect the Side Rest 126 to the Side Rest Pressure Plate 134, controls the amount of pressure required to slide the Side Rest 126 along the Support Base 120. With proper Pressure Plate 132 adjustment, weight applied to the Side Rest 126 by the instrumentalist will not cause the Side Rest 126 to move unwantedly. This is due to the fact that pressure applied to the Side Rest 126—especially toward the Side Rest Tip 128—causes a subtle twisting motion between the bottom of the Side Rest Base 130, the top of the Side Rest Pressure Plate 132, and the Support Base 120. This twisting motion "locks" the Side Rest 126 in place when weight is applied to it during use. Downward pressure, as described earlier, defeats this locking effect and allows the Side Rest 126 to be adjusted along the Support Base 120.

Figure 7A:
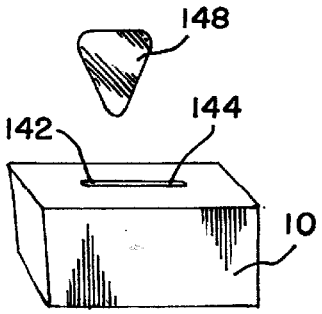
FIGS. 7A, 7B, and 7C are first, second, and third embodiments of guitar pick holders built into the body of the guitar of FIG. 1.

FIG. 7A illustrates the first embodiment of a guitar pick holder built into the front face of the Main Body 10 of the present invention. A narrow Routed Channel 142 is cut into the Main body 10 of the guitar. The channel is sufficient in size and depth to hold a standard size Guitar Pick 148, but not so deep that the Guitar Pick 148 can be lost inside of it. The inside of the Channel 142 is coated with a Rubber or Sponge-like Material 144, which gently grabs but does not adhere to the Guitar Pick 148 when inserted. Approximately twenty-five to thirty percent of the Guitar Pick 148 remains above the Main Body 10 of the guitar when fully inserted. This allows for its easy removal when needed. This embodiment is in use on the current prototype.

Figure 7B:
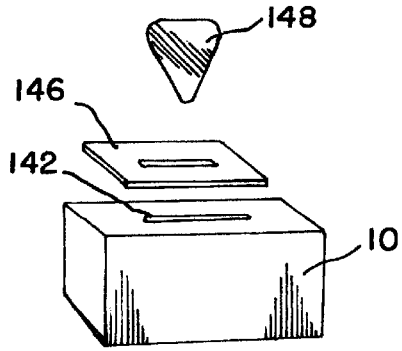
Figure 7C:
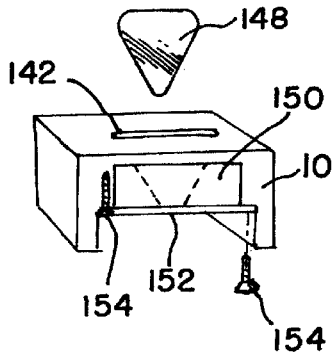

FIG. 7B illustrates the second embodiment of a guitar pick holder built into the Main Body 10 of the guitar. A narrow Routed Channel 142 is cut into the Main body 10 of the guitar. The channel is sufficient in size and depth to hold a standard size Guitar Pick 448, but not so deep that the pick can be lost inside of it. A thin rubber sheet 148 a slit in it is attached to the Main Body 10 above the Channel 142. The Guitar Pick 148 is held in place by the edges of the slit in the Rubber Sheet 146.

FIG. 70 illustrate the third embodiment of a guitar pick holder built into the Main Body 10 of the guitar. A piece of Rubber Sponge-like Material 150 is mounted in a cavity beneath the surface of the Main Body 10 of the guitar. After The Guitar Pick 148 slides through the Routed Channel 142 it is held in place by a slit in the Sponge-like material 150. A Guitar Pick Depth Stop Plate 152 keeps the Guitar Pick 148 from going in too deep. The Depth Stop Plate 152 is attached to the Main Body 10 with the Depth Stop Plate Mounting Screws 154. This embodiment could also be installed beneath a standard guitar pickguard.

Figure 8:
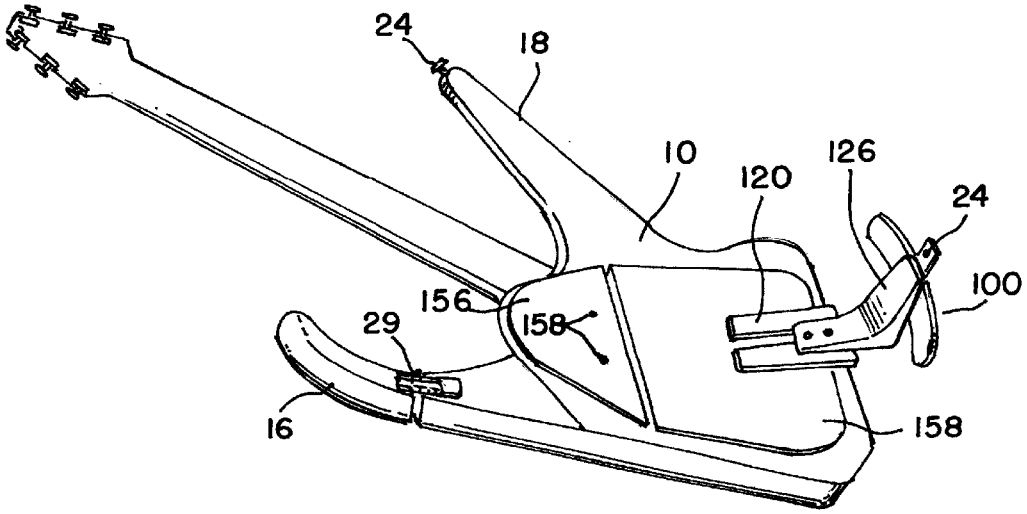
FIG. 8 is a rear angled elevational view of the overall shape of the guitar assembly of the present invention.

FIG. 8 is a rear angled elevational view of the overall shape of the guitar assembly of the present invention showing the placement and basic shape of the Ergonomic Belly Rest 156 upon the rear face of the guitar Main Body 10. The Belly Rest 156 is mounted to the guitar Main Body 10 with the Belly Rest Mounting Screws 158. Different Belly Rest 156 shapes and curvatures should be available to suit a variety of body types and tastes. Also pictured for reference are; Legrest 16, Legrest Locking Mechanism Assembly 29, Upper Horn 18, Armrest 100, Strap Buttons 24, Support Base 120, Control Cavity Cover Plate 158, and Siderest 126.

The invention being thus described, it will be obvious that the same may beg varied in many ways. Such variations are not to be regarded as a departure from the spirit and scope of the invention, and all such modifications as would be obvious to one skilled in the art are intended to be included within the scope of the following claims.

What is claimed:

1. The tremolo bar locking assembly for use on a string instrument comprising:

a tremolo bar fixed at one end adjacent a bridge of the stringed instrument on the main body thereof such that the tremolo bar is normally free to vibrate;

a slidable latch bar transversely movable under the tremolo bar upon actuation by an instrumentalist;

a guide plate for holding the latch bar having a slot for accommodating sliding movement thereof; and a first spring for biasing the latch bar against the guide plate.

2. The tremolo bar assembly of claim 1 further including a second spring for resiliently engaging an end of the latch bar when in a locked position thereof.

* * * * *